US007163132B2

(12) United States Patent
Rundberg

(10) Patent No.: US 7,163,132 B2
(45) Date of Patent: Jan. 16, 2007

(54) CARRIER DEVICE FOR AN ENGINE POWERED TOOL

(75) Inventor: Leena Rundberg, Norrahammer (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 10/485,238

(22) PCT Filed: May 30, 2002

(86) PCT No.: PCT/SE02/01057

§ 371 (c)(1),
(2), (4) Date: Aug. 25, 2004

(87) PCT Pub. No.: WO02/096238

PCT Pub. Date: Dec. 5, 2002

(65) Prior Publication Data

US 2005/0000994 A1 Jan. 6, 2005

(30) Foreign Application Priority Data

May 31, 2001 (SE) ..... 0101921

(51) Int. Cl.
*A45F 1/04* (2006.01)

(52) U.S. Cl. ..... 224/637; 224/907

(58) Field of Classification Search ..... 224/637, 224/646, 648, 661, 259, 268, 262, 907
See application file for complete search history.

(56) References Cited

U.S. PATENT DOCUMENTS

| | | | | |
|---|---|---|---|---|
| 119,400 | A * | 9/1871 | Penrose | 224/148.6 |
| 4,776,504 | A | 10/1988 | Panth | |
| 5,913,464 | A * | 6/1999 | Haberlein | 224/259 |
| 5,915,606 | A * | 6/1999 | Jensen | 224/148.6 |
| 5,954,249 | A * | 9/1999 | Panth | 224/234 |
| 6,247,624 | B1 * | 6/2001 | Rundberg | 224/259 |
| 6,345,751 | B1 * | 2/2002 | Elliot | 224/646 |

* cited by examiner

*Primary Examiner*—Lien M. Ngo
(74) *Attorney, Agent, or Firm*—Pearne & Gordon LLP

(57) ABSTRACT

A harness is used for carrying portable tools like trimmer and clearing saws. The harness comprises at least two straps (11) that pass over the shoulders of the operator and a waist belt (17) secured to a plate (12) placed on the back of the operator. A hip pad (15) hanging in a string or a rope (16) running between the plate (12) and a device (13) placed on the chest of the operator. In order to make the operator carry more of the tool weight by the waist belt is the hip pad (15) secured to the plate (12) on the back of the operator by a third strap (19).

18 Claims, 2 Drawing Sheets

CARRIER DEVICE FOR AN ENGINE POWERED TOOL

Figure 1:
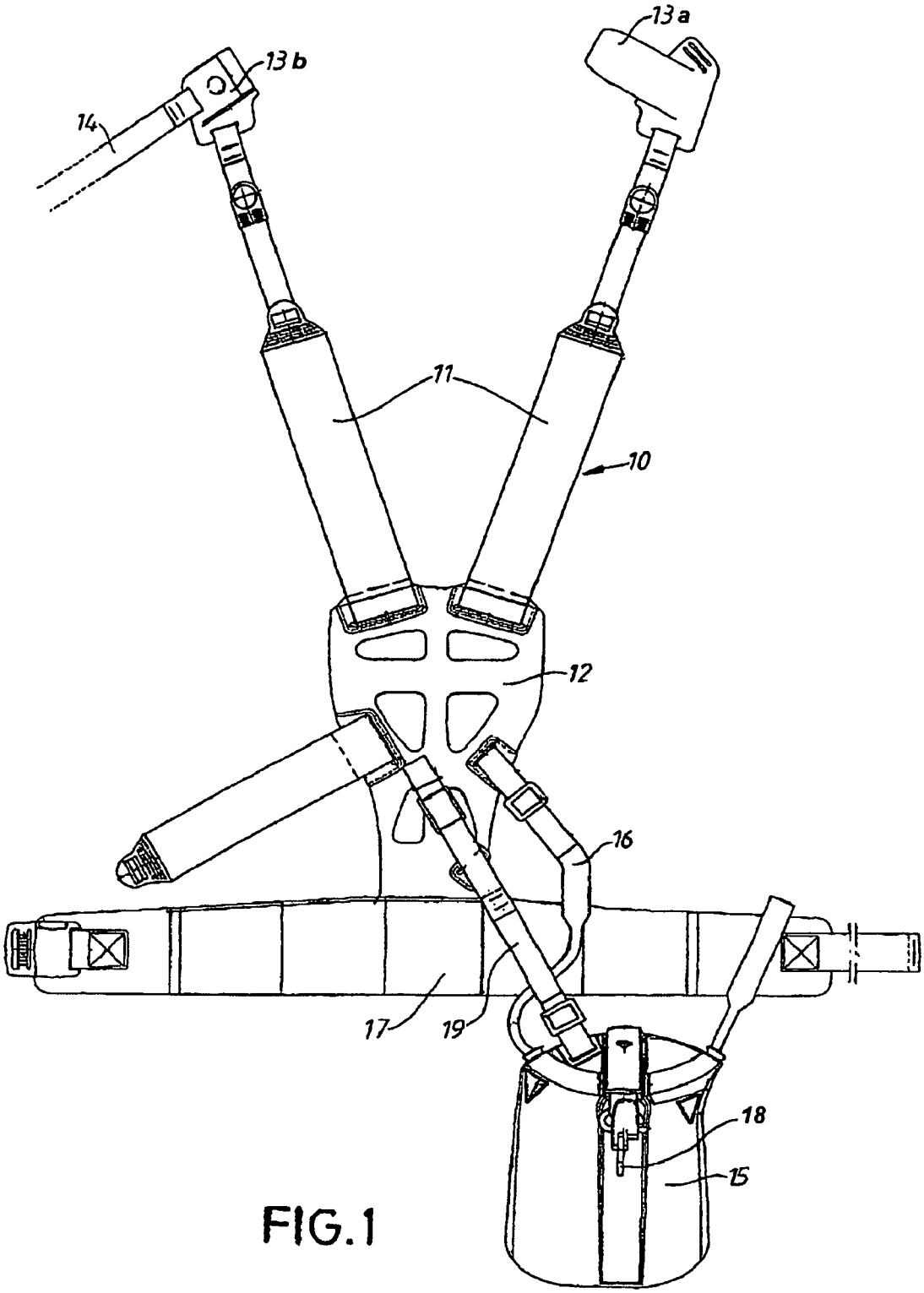

Engine powered tools like for example clearing saws, trimmers and brush cutters are widely used for work in forests and gardens. The different types of tools are available in different sizes that are developed to meet the requirements for the work. The operator often works long shifts with the tool and the body of the operator will therefore be exposed to big loads.

In order to improve the working conditions for the operator are these tools carried in a harness placed on the back, shoulders and hip of the operator. The tool is attached to the harness by a hook placed on a hip pad that is hanging down from the harness in a rope. The hip pad is during use placed close to one of the hips of the operator. The use of a harness for carrying the tool reduces the loads on the arms of the operator since most of the tool weight is carried by the back and the shoulders of the operator instead of the operator's arms that are used for the control of the tool. The hip pad is used to reduce the wear from the hook that is connected to the tool and to support the tool on the hip of the operator. The position of the hip pad is adjustable in order to suite operators with different length. The straps on the harness are also adjustable to be comfortable for the operator to wear.

The harnesses available on the market today are designed to meet the requirements in laws that regulates these kind of tools in order to guarantee the safety of the operator. These harnesses are designed so that the operator can open the harness by one single handle that should be placed so that it is easy for the operator to reach when the harness is in its right position on the operator. This means that when the operator opens the harness is will fall off the shoulders of the operator and down to the ground so that the operator gets free from the tool. A harness designed like this however has the drawback that it is very difficult to make it comfortable for the operator to wear.

New laws though replace the laws that the known harnesses are designed to meet. According to the new laws must it be possible to release the tool from the operator in an easy way instead of the tool and the harness like the previous laws stated. This means that the operator must be able to release the tool from the harness very quick and by using only one hand. If the release mechanism is moved to the hook on the hip pad that the tool is attached to can the harness be designed to suite the operator as good as possible. The new type of harness is therefore more ergonomic and reduces the loads on the operator.

The known models of harnesses have two straps that are placed over the shoulders of the operator like the straps on a rucksack. One end of the straps are secured to a plate placed on the back of the operator and the other end is secured to a device, placed on the chest of the operator, that can be opened so that the straps are released from the device. There is also a third strap running between the plate on the back of the operator and the device on the chest of the operator. This third strap is placed on the opposite side of the operator as the tool and is running underneath the operator's arm. On the opposite side of the operator as the third strap is the hip pad hanging in a rope with adjustable length secured in one end to the plate on the back of the operator and the other end to the device on the chest of the operator. Since the length of the rope can be adjusted is it possible for the operator to alternate the height of the hip pad and consequently the tool that is attached to the hip pad. This makes it possible for different operators to select a suitable height for the tool. The device on the chest of the operator can be opened so that the two straps are released from the device to let the harness and the tool drop to the ground if there is problems with the tool that could affect the safety of the operator. To make this arrangement work properly can the hip pad only be hanging in a rope or a strap, which means that the biggest part of the tool weight is carried by the shoulders of the operator. This means that the use of such a harness will be very tiring for the shoulders and back of the operator.

The new type of harness has a more advanced design than the harness described above. The design of the known harnesses has though been the framework for the new harness that is provided with several details.

The claimed harness has a smaller device on the chest of the operator for securing the different straps that is included in the harness and also an extra elastic strap acting between the lower part of the plate on the back of the operator and the hip pad. The elastic strap pulls the hip pad towards the operator and reduces the weight that is carried by the rope so that a bigger part of the tool weight is carried by the belt placed around the waist of the operator. The length of the elastic strap is adjustable in both ends of the strap in order to suite the operator and the tool that is used.

One embodiment of the claimed invention is illustrated in the drawings.

FIG. 1. Illustrates the harness.

Figure 2:
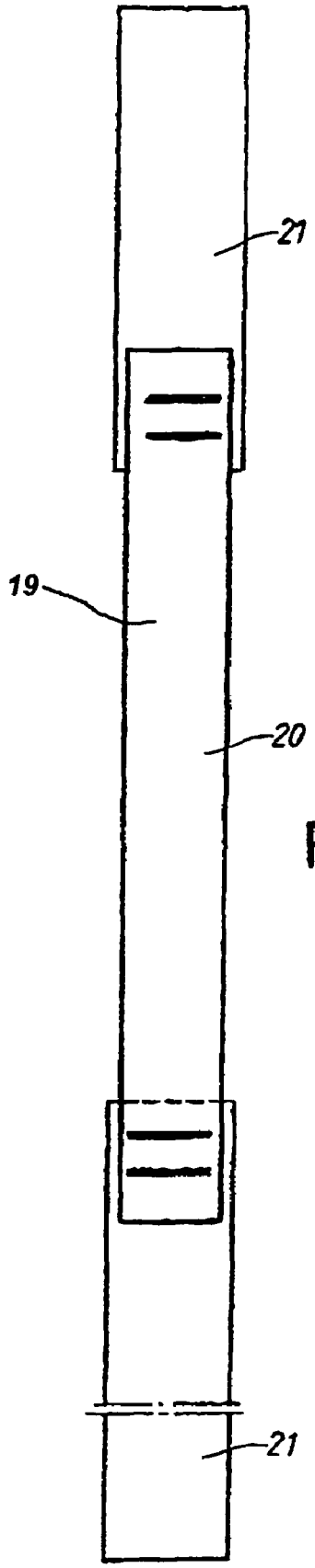

FIG. 2. Illustrates the elastic strap.

In order to facilitate the situation for the operator are trimmers and clearing saws normally carried in a harness 10. The harness 10 comprises two straps 11 that are placed on the shoulders of the operator. The straps is in one end secured to a stiff plate 12 placed on the back of the operator while the other end of the straps 11 is secured to a device that consists of two parts, 13*a* and 13*b*, that are secured to each other so that the straps are connected on the chest of the operator. From the two parts, 13*a* and 13*b*, is a third strap running between the device on the chest of the operator and the stiff plate 12 on the back of the operator. On the opposite side of the operator compared to the third strap is a hip pad 15 hanging in a rope 16 or a string that is running between the device on the chest and the stiff plate 12 on the back of the operator The hip pad 15 is movable along the rope 16 or string that has an adjustable length so that the position of the hip pad 15 can be optimised for the operator and the tool that is used. A waist belt 17 is also attached to the stiff plate 12 on the back of the operator in order to reduce the loads on the shoulders and the back of the operator.

The tool is attached to a hook 18 placed on the hip pad 15 so that the weight of the tool is carried by the harness 10. To reduce the weight carried by the shoulder and the back of the operator further is the hip pad 15 also secured to the harness 10 by an elastic or non-elastic strap 19 that is running between the hip pad 15 and the stiff plate 12 on the back of the operator. This elastic or non-elastic strap 18 rearranges the loads on the operator so that the waist belt 17 instead of the shoulders carries the more of the tool weight. The elastic or non-elastic strap 19 is preferably made of an elastic material that reduces movements in the tool so that the comfort for the operator is improved.

The strap 19 can be designed in different ways. One solution is to use an elastic material for a midsection 20 of the strap 19 and a more non-elastic material 21 in the ends to make it easier to secure the strap to the device 13 on the chest of the operator and the stiff plate 12 on the back of the operator.

The invention claimed is:

1. A carrier device for a portable tool, the carrier device comprising:

a plate (12) configured to be placed on the back of an operator;

at least two straps (11) secured to the plate (12) and configured to pass over the shoulders of the operator;

a device (13) secured to the straps (11) and configured to be placed on the chest of the operator;

a waist belt (17) secured to the plate (12) and configured to pass around the waist of the operator;

a string or a rope (16) extending continuously between the plate (12) and the device (13);

a hip pad (15) hanging on the string or rope (16), the hip pad (15) being slidably movable along the string or rope (16) and configured to be placed at a hip of the operator; and a third strap (19) secured to the plate (12) and extending directly from the plate (12) to the hip pad (15) secure the hip pad (15) directly to the plate (12) at the back of the operator, the third strap (19) not being part of or directly connected to the string or a rope (16) extending between the plate (12) and the device (13).

2. A carrier device according to claim 1, wherein the third strap (19) has a length that can be adjusted.

3. A carder device according to claim 1, wherein the third strap (19) is secured directly to a top section of the hip pad (15) such that the hip pad (15) is supported by the third strap (19).

4. A carrier device according to claim 1, wherein at least one section of the third strap (19) is made of an elastic material.

5. A carrier device according to claim 1, wherein the plate (12) placed on the back of the operator is made of a stiff material.

6. A carrier device according to claim 1, wherein the hip pad (15) includes at least one portion through which the string or rope (16) extends to permit the sliding movable of the hip pad (15) along the string or rope (16).

7. A carrier device according to claim 1, wherein the string or rope (16) has a length that can be adjusted independently of the Third strap (19).

8. A carrier device according to claim 1, wherein the string or a rope (16) is secured to the plate (12) at a location that is different than a location at which the third strap (19) secured to the plate (12).

9. A carrier device according to claim 1, wherein the hip pad (15) includes at least one portion through which the string or rope (16) extends to permit the sliding movable of the hip pad (15) along the string or rope (16), the string or rope (16) extends from the hip pad (15) toward the plate (12) at one portion of the hip pad (15) and extends from the hip pad (15) toward the device (13) at a second portion of the hip pad (15), the third strap (19) is secured to the hip pad (15) at a third portion of the hip pad (15) that is different from the first and second portions and is located between the first and second portions.

10. A carder device for a portable tool, the carrier device comprising:

a plate (12) configured to be placed on the back of an operator;

at least two straps (11) configured to pass over the shoulders of the operator;

a device (13) configured to be placed on the chest of an operator;

a waist belt (17) secured to the plate (12);

a string or a rope (16) extending between the plate (12) and the device (13);

a hip pad (15) hanging on the string or rope (16); and a third strap (19) directly securing the hip pad (15) to the plate (12) on the back of the operator, the third strap (19) extending from behind the back of the operator to the hip pad (15) without extending in front of the operator and the length of the third strap (19) being adjustable.

11. A carrier device according to claim 10, wherein the third strap (19) is directly secured to a top section of the hip pad (15) such that the hip pad (15) is supported by the third strap (19).

12. A carrier device according to claim 11, wherein at least one section of the third strap (19) is made of an elastic material.

13. A carrier device according to claim 12, wherein the plate (12) placed on the back of the operator is made of a stiff material.

14. A carrier device according to claim 10, wherein the third strap (19) is not part of or directly connected to the string or a rope (16) extending between the plate (12) and the waist belt (17).

15. A carrier device according to claim 14, wherein the hip pad (15) includes at least one portion through which the string or rope (16) extends to permit sliding movable of the hip pad (15) along the string or rope (16).

16. A carrier device according to claim 15, wherein the string or rope (16) has a length that can be adjusted independently of the third strap (19).

17. A carrier device according to claim 16, wherein the string or a rope (16) is secured to the plate (12) at a location that is different than a location at which the third strap (19) is secured to the plate (12).

18. A carrier device according to claim 17, wherein the string or rope (16) extends from the hip pad (15) toward the plate (12) at one portion of the hip pad (15) and extends from the hip pad (15) toward the device (13) at a second portion of the hip pad (15), the third strap (19)15 secured to the hip pad (15) at a third portion of the hip pad (15) that is different from the first and second portions and is located between the first and second portions.

* * * * *

UNITED STATES PATENT AND TRADEMARK OFFICE

CERTIFICATE OF CORRECTION

PATENT NO. : 7,163,132 B2
APPLICATION NO. : 10/485238
DATED : January 16, 2007
INVENTOR(S) : Leena Rundberg It is certified that error appears in the above-identified patent and that said Letters Patent is hereby corrected as shown below:

In column 4, claim 10, line 1, please delete “carder” and insert therefor --carrier--.

In column 4, claim 18, line 52, after (19) please delete “15” and insert therefor --is--.

Signed and Sealed this

First Day of April, 2008

JON W. DUDAS
*Director of the United States Patent and Trademark Office*